US008627515B1

(12) United States Patent
Scott

(10) Patent No.: US 8,627,515 B1
(45) Date of Patent: Jan. 14, 2014

(54) MULTIFACETED LIGHTWEIGHT COLLAPSIBLE HAT

(76) Inventor: Harold Lamont Scott, Newark, NJ (US)

( * ) Notice: Subject to any disclaimer, the term of this patent is extended or adjusted under 35 U.S.C. 154(b) by 389 days.

(21) Appl. No.: 12/913,283

(22) Filed: Oct. 27, 2010

Related U.S. Application Data

(60) Provisional application No. 61/280,119, filed on Oct. 31, 2009.

(51) Int. Cl.
*A42B 1/00* (2006.01)

(52) U.S. Cl.
USPC ..... 2/175.1; 2/195.1

(58) Field of Classification Search
USPC ..... 2/175.1, 195.1, 200.1, 209.12, 171.1, 2/171.6, 171.8, 181.4, 182.8, 175.2, 2/175.3, 175.4, 175.5, 175.8, 175.9, 175, 2/5; 112/475.11, 117, 475.22
See application file for complete search history.

(56) References Cited

U.S. PATENT DOCUMENTS

| | | | | | |
|---|---|---|---|---|---|
| 1,024,750 | A | * | 4/1912 | Stevens | 2/182.1 |
| 1,412,479 | A | * | 4/1922 | Mayleas | 2/175.1 |
| 1,598,379 | A | * | 8/1926 | Kerr | 2/171.02 |
| 2,493,500 | A | * | 1/1950 | Rankin | 2/175.9 |
| 2,673,349 | A | * | 3/1954 | Key | 2/175.1 |
| 2,716,753 | A | | 9/1955 | Gordon | |
| 2,803,015 | A | * | 8/1957 | Milone | 2/171.03 |
| 3,459,179 | A | * | 8/1969 | Olesen | 601/134 |
| 3,869,727 | A | * | 3/1975 | Hartman et al. | 2/175.1 |
| 4,096,590 | A | * | 6/1978 | Keshock | 2/175.5 |
| D255,840 | S | | 7/1980 | Day | |
| 4,386,437 | A | * | 6/1983 | Fosher | 2/209.13 |
| 4,682,373 | A | | 7/1987 | Baran | |
| D352,596 | S | | 11/1994 | Williams, Jr. | |
| 5,410,760 | A | * | 5/1995 | Zumbiel | 2/195.1 |
| 5,488,740 | A | * | 2/1996 | Garza | 2/175.1 |
| 5,579,540 | A | * | 12/1996 | Walker | 2/209.11 |
| 5,685,017 | A | * | 11/1997 | Kraft | 2/171.1 |
| 5,857,219 | A | * | 1/1999 | Edmark | 2/182.2 |
| 5,890,230 | A | * | 4/1999 | Guo | 2/175.1 |
| 6,012,174 | A | | 1/2000 | Rech et al. | |
| 6,018,821 | A | * | 2/2000 | Adams | 2/209.11 |
| 6,061,835 | A | * | 5/2000 | Lien | 2/175.5 |
| 6,101,632 | A | | 8/2000 | Veazey | |

(Continued)

OTHER PUBLICATIONS

The Art of Manipulating Fabric, 1996, Colette Wolff, Krause Publishing.*

(Continued)

*Primary Examiner* — Shelley Self
*Assistant Examiner* — Catherine M Ferreira
(74) *Attorney, Agent, or Firm* — Goldstein Law Offices, P.C.

(57) ABSTRACT

A high fashion, crushable, lightweight, collapsible hat using a method of construction that produces a blockable, washable, stylish, comfortable, pliable, breathable hat, that maintains its original shape or can be easily restored to its original shape. The hat employs an open-cell foam material and a plurality of woven materials in a lamination, all materials being breathable and lightweight and as well as a method of construction that is versatile and usable for countless variations is style. The lamination is blockable even when fabrics that are not traditionally blockable are used. A stitching pattern of topstitching forms a plurality of sacs that maintain the original shape of the hat after blocking by creating an air bubble matrix structure that refills after crushing. Optional trim elements are constructed from the lamination using the stitching pattern to create a wide variety of high fashion hats styles with flat or peaked crowns.

6 Claims, 4 Drawing Sheets

(56) References Cited

U.S. PATENT DOCUMENTS

| | | | | |
|---|---|---|---|---|
| 6,155,189 | A * | 12/2000 | Walner | 112/475.01 |
| 6,216,277 | B1 | 4/2001 | Cheng | |
| 6,261,397 | B1 * | 7/2001 | Repp et al. | 156/93 |
| 6,423,165 | B1 * | 7/2002 | Hishinuma | 156/85 |
| 6,561,393 | B1 * | 5/2003 | Cheng | 2/171.03 |
| 6,895,878 | B2 * | 5/2005 | Stutznacker | 112/117 |
| 6,904,617 | B2 * | 6/2005 | Tsai | 2/209.13 |
| 7,062,793 | B2 * | 6/2006 | Liao | 2/172 |
| 7,109,134 | B2 * | 9/2006 | South | 442/150 |
| 7,140,313 | B2 * | 11/2006 | Neustat | 112/475.08 |
| D553,331 | S * | 10/2007 | Henson | D2/893 |
| D639,532 | S * | 6/2011 | Malarky, Ii | D2/878 |
| D664,330 | S * | 7/2012 | Wiggins | D2/888 |
| 8,388,791 | B2 * | 3/2013 | Dojan et al. | 156/242 |
| 2004/0006808 | A1 * | 1/2004 | Ranzer | 2/200.3 |
| 2004/0093658 | A1 * | 5/2004 | Jackson | 2/195.1 |
| 2006/0053527 | A1 * | 3/2006 | Schneider | 2/171.1 |
| 2008/0295222 | A1 * | 12/2008 | Cunliffe | 2/175.2 |
| 2010/0132092 | A1 * | 6/2010 | Temblador | 2/182.8 |
| 2010/0186147 | A1 * | 7/2010 | Garza | 2/209.12 |
| 2011/0094029 | A1 * | 4/2011 | Johnson | 5/502 |
| 2011/0094555 | A1 * | 4/2011 | Franta | 135/143 |
| 2012/0180193 | A1 * | 7/2012 | Curiel | 2/209.11 |
| 2012/0210491 | A1 * | 8/2012 | Bryan et al. | 2/181.4 |
| 2013/0055590 | A1 * | 3/2013 | Mokos | 36/45 |

OTHER PUBLICATIONS

Art: Quilts and Quilters: Techniques—Trapunto—Museum Link—Illinois www.museum.state.il.us//muslink/art/htmls/ks_tech_t.html.*

Donna Vinci Collections—www. donnavinci.com—Wayback Machine Dated Feb. 22, 2009.* www.villageheatshop.com—Betmar Quilted Rain Bucket Hat—Way Back Machine Dated Sep. 29, 2008.*

Couture Sewing Techniques, Claire Schaeffer, 2011, The Taunton Press, Selected Glossary of Terms.*

Hsitorical Fashion in Detail—The 17$^{th}$ and 18$^{th}$ Centuries, V & A Publishing (Apr. 1, 2009), Front Cover.* http://www.librarything.com/topic/53497 Project 1929, 1929 Womens Fashions.*

PRWeb—Donna Vinci Debuts Inauguration Collection 2009—with Portion of Proceeds Dedicated to the Oprah Winfrey Leadership Academy for Girls—New York, NY (PRWEB) Dec. 4, 2008.* http://www.frenchnovelty.com/Donna-Vinci-MOB/.* http://donnavinci.com Donna Vinci Newsletter vol. 4_3 and vol. 3_8 Donna Vinci Collections—Hats and Accessories 2006-2008; Donna Vinci Collection Aug. 18, 2006—Figure 3; Donna Vinci Collection Jul. 22, 2007—Figure 4; Donna Vinci Collection Mar. 29, 2007—Figure 3.*

* cited by examiner

MULTIFACETED LIGHTWEIGHT COLLAPSIBLE HAT

CROSS-REFERENCE TO RELATED APPLICATIONS

This application is a nonprovisional utility application of provisional patent application Ser. No. 61/280,119, filed in the United States Patent Office on Oct. 31, 2009 and claims the prior thereof.

BACKGROUND OF THE INVENTION

The invention relates generally to a crushable, lightweight, collapsible hat and a method of construction thereof. More particularly, the invention relates to a crushable, lightweight high-fashion hat made from a plurality of lightweight, breathable and blockable materials that is constructed by a method of layering and cutting the materials and stitching the layers in a manner that maintains the shape of the hat and helps restore the shape after crushing.

Although relaxed fit hats, such as caps and berets are perennial fashion favorites, fashion trends have revived an interest in hats with a more formal, finished look with a defined shape and structure. Customarily, these types of hats were made from traditional materials such as felt or straw. Manufacturing places natural stresses on fabrics that may result in deviations from its intended shape and size. To form hats into a defined shape and structure, milliners used a process called blocking. Through heat and moisture, blocking sets the stitches and standardizes the final dimensions, and may enhance the drape and folds of the materials. Blocking gives a hat its shape and style.

Blocking is a deceptively easy process that can either create beautiful headwear or ruin the piece. First, steam or heat is applied to the hat either from the inside or outside. The hat is placed on the block, which is typically head-shaped. A flange is used for brims after the head blocking is complete. The block is typically wood although other new plastic materials are also being used. The hat is steamed from the inside or outside, either before placement on the block or immediately after. The milliner or hat maker shapes the hat by hand into the desired style and shape by alternatively applying pressure and heat. Once the hat is in the desired shape, it is allowed to dry, removed from the block, and allowed to further dry.

Generally blocked hats made from traditional materials require considerable maintenance. They must be stored in hatboxes or other containers that take up considerable space to avoid crushing or collapsing while traveling or storing. Traditional blocked hats must be dry-cleaned and protected from the rain and excessive moisture. In most cases, the hats are sized or stiffened to add support; however, the sizing agents are water-soluble, thus causing the materials to lose their shape-retaining properties when wet. Failure to properly maintain and store blocked hats often results in a shapeless, ruined head covering.

Relaxed-fit hats eliminate the maintenance challenges of blocked hats. They are generally made from a much wider variety of fabrics without being restricted to felt and straw and use an interfacing of a variety of materials, including foam. They are often washable, pliable, lightweight and breathable, admitting air to the skin and allowing sweat to evaporate. However, they are limited to casual wear such as sports hats, berets, and caps because they cannot be blocked to hold a particular shape. As a result, the high fashion appearance of a blocked hat cannot be achieved with the materials and techniques used to manufacture relaxed-fit hats. A blockable high fashion hat that is also pliable, washable, stylish, comfortable, lightweight, breathable, collapsable and maintains or can be easily restored to its original shape is highly paradoxical using current methods and materials of hat construction.

While these units may be suitable for the particular purpose employed, or for general use, they would not be as suitable for the purposes of the present invention as disclosed hereafter.

SUMMARY OF THE INVENTION

It is an object of the invention to produce a crushable, lightweight, collapsible hat that is breathable. Accordingly, the crushable, lightweight, collapsible hat is constructed with breathable materials, such as open-cell foam, open-mesh material and woven fabric in a plurality of layers forming a lamination, that is porous, admitting air to the skin and scalp and allowing sweat to evaporate.

It is a further object of the invention to produce a crushable, lightweight, collapsible hat that is high fashion, using styles that require traditional blocking and fabrics that traditionally did not respond to the blocking process. Accordingly, the crushable, lightweight, collapsible hat is constructed from open-cell foam and woven materials, such as high fashion fabrics, sandwiched in a lamination that is blockable in a traditional manner.

It is another object of the invention to produce a crushable, lightweight, collapsible hat that maintains its shape or is easily restored to its original shape. Accordingly, the crushable, lightweight, collapsible hat is topstitched with a stitching pattern that creates sacs in the lamination that form an air bubble matrix structure when blocked, that after crushing the hat expelling the air out, refills with air to reform the matrix structure and original shape.

The invention is a high fashion, crushable, lightweight, collapsible hat using a method of construction that produces a blockable, washable, stylish, comfortable, pliable, breathable hat, that maintains its original shape or can be easily restored to its original shape. The hat employs an open-cell foam material and a plurality of woven materials in a lamination, all materials being breathable and lightweight and as well as a method of construction that is versatile and usable for countless variations is style. The lamination is blockable even when fabrics that are not traditionally blockable are used. A stitching pattern of topstitching forms a plurality of sacs that maintain the original shape of the hat after blocking by creating an air bubble matrix structure that refills after crushing. Optional trim elements are constructed from the lamination using the stitching pattern to create a wide variety of high fashion hats styles with flat or peaked crowns.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 3:
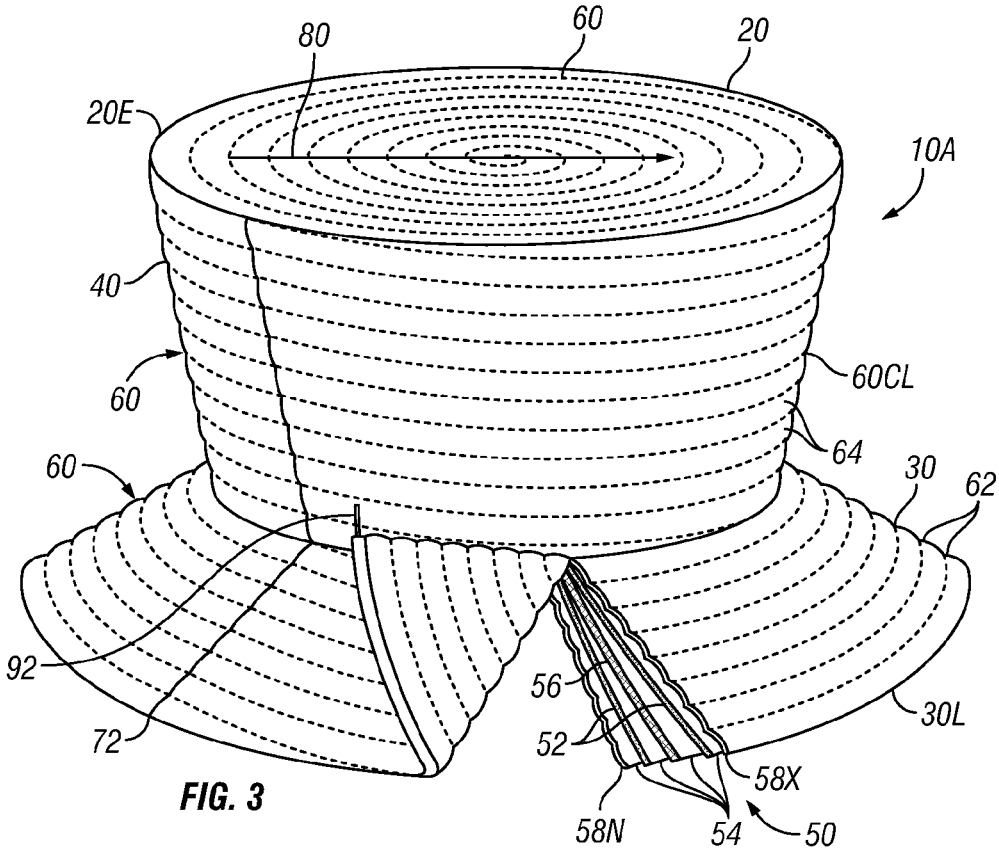
FIG. 3 is a diagrammatic perspective view of a further high fashion hat, showing a cutaway portion, demonstrating a plurality of layers of materials producing the crushable, blockable construction.

FIG. 3 illustrates a high fashion, crushable, lightweight, collapsible hat 10A using a method of construction that produces a blockable, washable, stylish, comfortable, pliable, breathable hat 10A that maintains its original shape or can be easily restored to its original shape. The hat 10A employs an open-cell foam material and a plurality of woven materials, all materials being breathable, and lightweight, as well as a method of construction that is versatile and usable for countless variations is style. Breathable materials admit air to the skin and scalp, allowing sweat to evaporate. The illustrated hat 10A has a plurality of elements such as a flat crown 20, a brim 30 and at least one band 40. The hat 10A has a stitching pattern 60 of topstitching to create a plurality of rows 62 and a plurality of layers of breathable, lightweight, materials in a lamination 50 that is blockable, that is, responding to heat and steam during the blocking process, producing the crushable, blockable hat construction. The lamination 50 is blockable even when fabrics that are not traditionally blockable are used. The stitching pattern 60 forms a plurality of sacs that maintain the original shape of the hat 10A after blocking.

In this discussion, the term blocking is for the process of steaming or applying heat to a hat either from the inside or outside, placing the hat on a head-shaped block, or placing the brim of the hat on a flange after the head blocking is complete, steaming from the inside or outside, shaping the hat into the desired style and shape by alternatively applying pressure and heat, and removing from the block to dry.

The lamination 50 is formed by sandwiching with a plurality of open-cell foam layers 52 having a pair of plane surfaces, having at least one layer of foam 52 between a pair of surface layers of woven fabric 58 by adhering the foam layer 52 to the fabric layers 58 with a plurality of adhesive layers 54. In other embodiments, an open-mesh layer 56 and, optionally, an additional layer of foam 52, are sandwiched in between the fabric layers by more adhesive layers 54. The grain of all woven materials, such as the fabric layer 58 and the open-mesh layer 56 are aligned before forming the lamination 50. The lamination has an inner surface fabric layer 58N and an outer surface fabric layer 58X. The inner surface fabric 58N is selected from breathable, lightweight and steam-compatible lining fabric and the outer surface layer fabric 58X is selected on high fashion appearance, breathability, lightness in weight, and compatibility with steam heat. The outer surface layer of fabric 58X includes and is not limited to felt and straw but also includes traditionally non-blockable high fashion fabrics such as silk, nylon, polyester, blends, metallics or other lightweight, breathable fabrics compatible with steam heat. These lightweight, breathable, steam-compatible fabrics desired for high fashion hats are too numerous for this discussion and are well-known to those of ordinary skill and beyond the scope of this discussion.

FIG. 3 shows, in a cutaway section, the plurality of layers of materials forming the lamination 50 to produce the blockable construction. In FIG. 3, the outer surface fabric layer 58X is adhered to the adhesive layer 54 to the foam layer 52. The foam layer 52 is adhered to the open-mesh layer 56 by a second adhesive layer 54. The open-mesh layer 56 is adhered to the second foam layer 52 by a third adhesive layer 54. The second foam layer 52 is adhered to the inner surface fabric layer 58N by a fourth adhesive layer 54.

Figure 1:
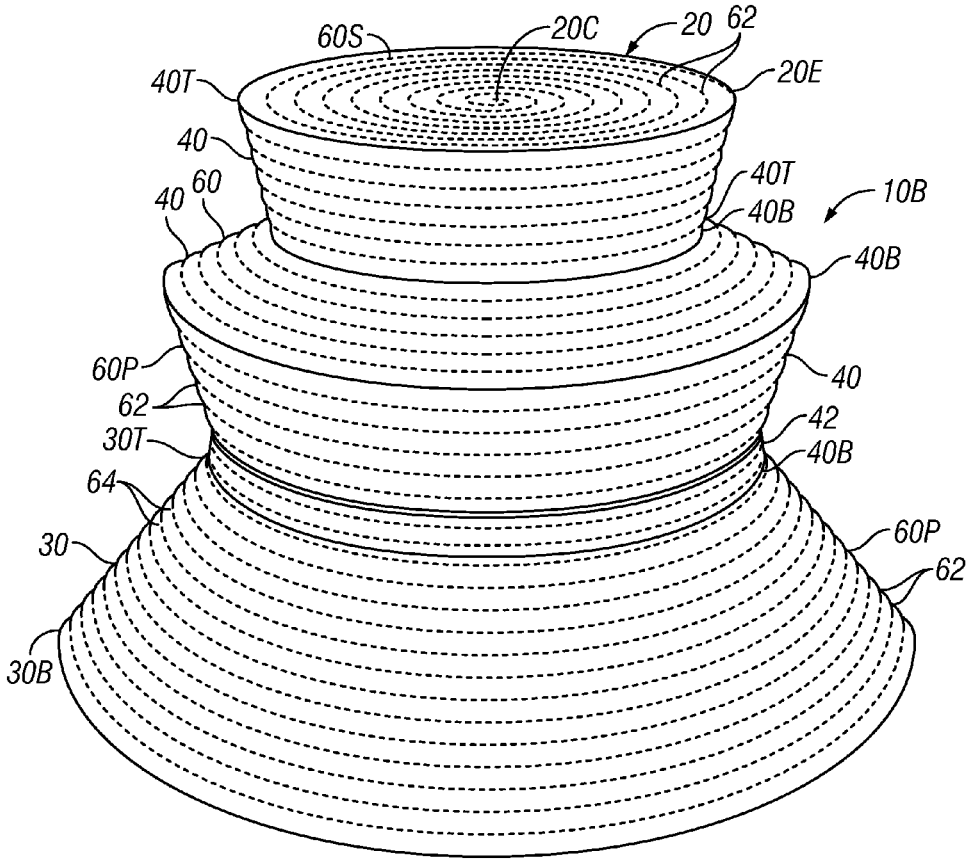
FIG. 1 is a diagrammatic perspective view of a high fashion hat showing a stitching pattern producing a crushable, blockable construction.

FIG. 1 shows another high fashion hat 10B with a plurality of bands 40, and a trim element 42. The hat 10B is constructed from the lamination described hereinabove. The crown 20, the brim 30, the bands 40 and the trim element 42 are cut from the lamination into a plurality of panels. The stitching pattern 60 is sewn on the bands 40, the crown 20, the brim 30, and the trim element 42. The crown 20 is flat and annular with a center 20C and a circumferential edge 20E. In FIG. 1, the crown 20 has a spiral stitching pattern 60S, forming a plurality of rows 62 of topstitching, starting at the center 20C and spiraling outward to the circumferential edge 20E. In another embodiment the crown 20 is ovoid with a long axis, short axis and a center point at the intersection of the axes. The spiral stitching pattern for the ovoid crown starting at the center and spiraling outward in the ovoid shape of the crown to form the rows of topstitching. When the crown is ovoid, the straight-of-grain line of the woven materials is aligned with the long axis.

In FIG. 1, the plurality of bands 40 have a top edge 40T and a bottom edge 40B. The top edge 40T of a first band 40 is attached to the circumferential edge 20E of the crown. The top edge 40T of a second band 40 is attached to the bottom edge 40B of the first band 40. Additional bands are optionally attached according to the fashion design. The brim 30 has a top edge 30T and a bottom edge 30B. The top edge 30T of the brim 30 attaches to the bottom edge 40B of the last band 40 added.

Figure 6:
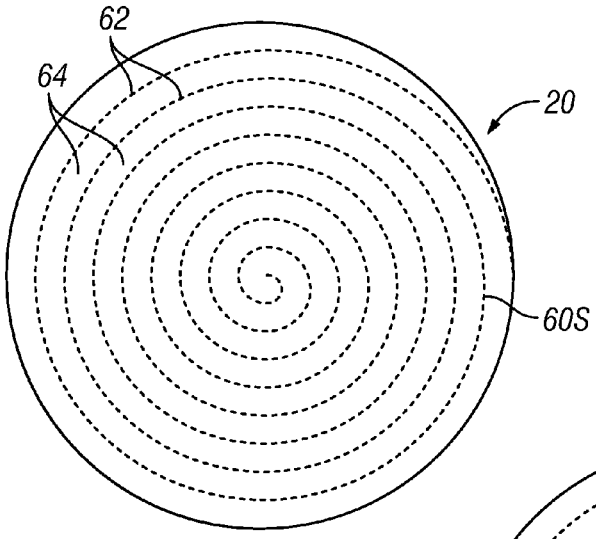
FIG. 6 is a top plan view of a flat crown of a high fashion hat using a spiral stitching pattern.
Figure 7:
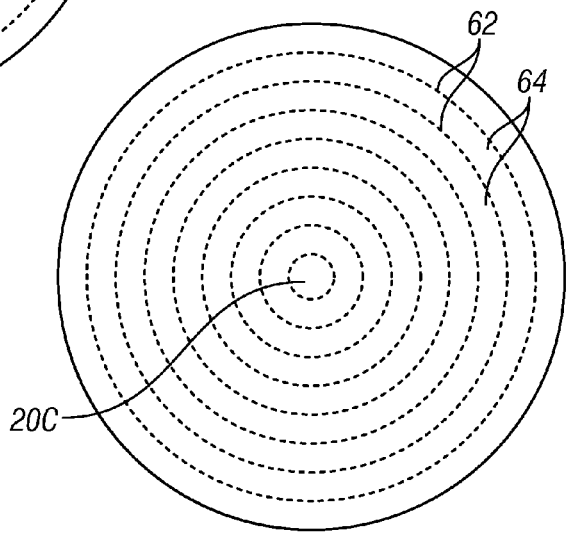
FIG. 7 is a top plan view of a flat crown of a high fashion hat using a concentric circular stitching pattern.

FIG. 6 shows the spiral stitching pattern 60S for the crown 20. The spiral stitching pattern 60S is easily executed using a sewing machine because the needle does not require repositioning, but stitches continuously from the center to the edge, creating the plurality of rows 62 of topstitches. There is a space 64 between each row 62 that is approximately the same width throughout the spiral stitching pattern 60S. Between the spiral stitching, in the space 64, the sac in the lamination is formed. FIG. 7 shows a further embodiment with a concentric stitching pattern 60C on the crown 20. Each row 62 of the top stitching is a discrete circle, all having the same center 20C. The space 64 between each row 62 is approximately the same width through the concentric stitching pattern 60C. Between the concentric stitching, in the space 64, the sac of the lamination formed.

Figures 4A, 4B, 4C:
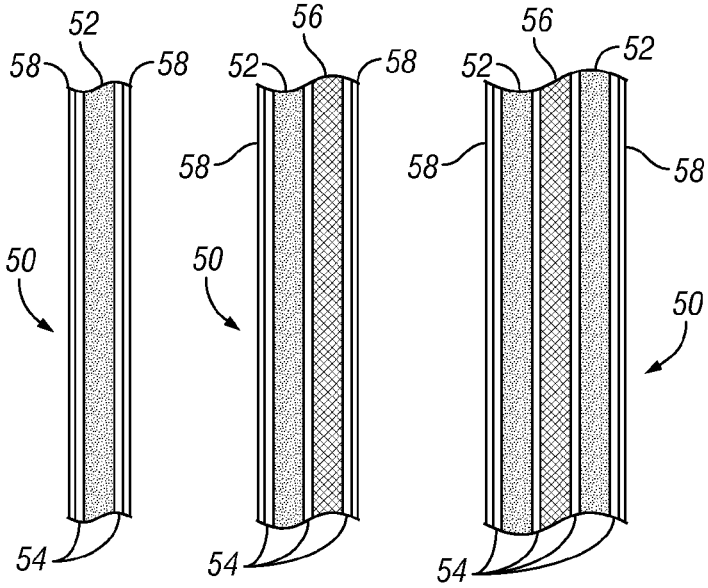
FIG. 4A is a cross-section view of a lamination, showing a center foam layer sandwiched between a pair of adhesive layers attaching a pair of fabric surface layers.
FIG. 4B is a cross-section view of the lamination, showing the center foam layer adhered to an open-mesh layer by the adhesive layer, forming a composite center layer, the center layer sandwiched between the pair of adhesive layers attaching the pair of fabric surface layers.
FIG. 4C is a cross-section view of the lamination, showing the center open-mesh layer sandwiched by a pair of foam layers adhered to the open-mesh layer by the pair of adhesive layers, forming the center composite layer, the center composite layer sandwiched between the pair of adhesive layers attaching the pair of fabric surface layers.

FIG. 4A shows the lamination 50 of the foam layer 52 adhered to the pair of fabric layers 58. The adhesive layers 54 are sprayed on, or are fusible interfacings that adhere two materials by fusing the materials to the interfacing with heat. The foam layer 52 is an open-cell foam thin sheet, of a polymeric material, such as, for example, but not limited to, foam rubber, EVA or polyurethane. The foam sheet has a thickness of approximately one-eight to one-fourth inch. It is understood by those of ordinary skill that the dimensions are provided for illustrative purposes and that variations in thickness of the foam sheet are possible within the inventive concept.

FIG. 4B shows the lamination 50 having the foam layer 52 adhered to the open-mesh layer 56 by the adhesive layer 54, forming a composite center layer, the center layer sandwiched between the pair of adhesive layers 54 attaching the pair of fabric layers 58. The open-mesh layer 56 is a slightly stiff, blockable, loosely woven fabric that has a large number of closely spaced holes, such as, for example, but not limited to, organdy, tulle, nylon, gauze, or horsehair.

FIG. 4C shows the lamination 50 having the open-mesh layer 56 sandwiched by a pair of foam layers 52 adhered to the open-mesh layer 56 by a pair of adhesive layers 54, forming a center composite layer, the center composite layer sandwiched between a pair of adhesive layers 54 attaching the pair of fabric layers 58. Other variations of the lamination using at least one open-cell foam layer and optionally the open-mesh layer adhering to the surface fabric layers by the plurality of adhesive layers are possible within the inventive concept. It is understood by those of ordinary skill that the composition of the lamination varies depending on the size, style and shape desired in the particular hat, while maintaining the lightweight, breathable, crushable characteristics of the invention.

Figure 5:
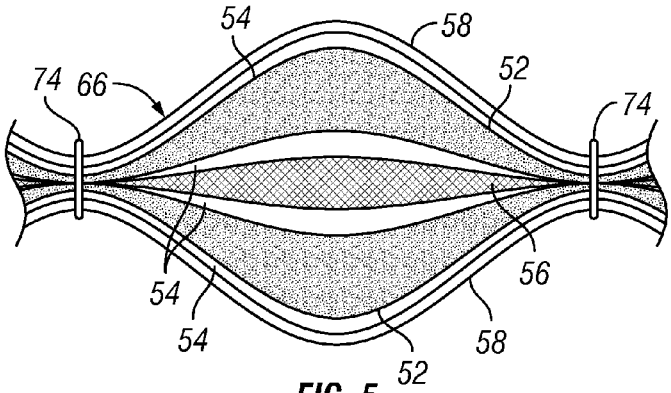
FIG. 5 is a cross-section view of a topstitched lamination producing the crushable, blockable construction, showing the sandwiched layers entrapping air between the stitches.

FIG. 5 demonstrates the sac 66 formed between the rows 62 of topstitches in the stitching patterns of the invention. A pair of topstitches 74 form the sac 66, one on each side of the sac. The stitches 74 are in the spiral or the concentric stitching pattern as described hereinabove or in parallel or coil-shaped stitching pattern as described hereinbelow. Between the topstitches, as illustrated, the lamination 50 has the center open-mesh layer 56 sandwiched by the pair of foam layers 52 adhered to the open mesh layer 56 by the pair of adhesive layers 54, forming a center composite layer, the center composite layer sandwiched between the pair of adhesive layers 54 attaching the pair of fabric surface layers 58. The foam layers 52 are open-cell foam, having an internal structure with a plurality of tiny air bubbles that are interconnected to form a complex matrix structure. During blocking using heat and steam, the foam layers form a new internal structure within the foam that is held firmly in place by the stitches 74. The new internal structure has elastic memory. When crushed, air leaves the open cell structure and when it is relaxed air returns to the open cell structure, returning the foam layers 52 to the original blocked shape. The optional open-mesh layer 56 provides additional support in the lamination 50 and allows air to enter and leave the foam layers 52.

Referring to FIG. 1, the illustrated high fashion hat 10*b* has a parallel stitching pattern 60P on the bands 40 and the brim 30 forming a plurality of rows 62 of stitching and the plurality of sacs in the spaces 64 between. The spaces 64 between each row 62 is approximately the same width throughout the parallel stitching pattern 60P. The parallel stitching pattern 60P is sewn onto the band 40 or the brim 30 after an oblong panel of lamination has been sewn into a closed circle to form the band or brim.

Figure 2:
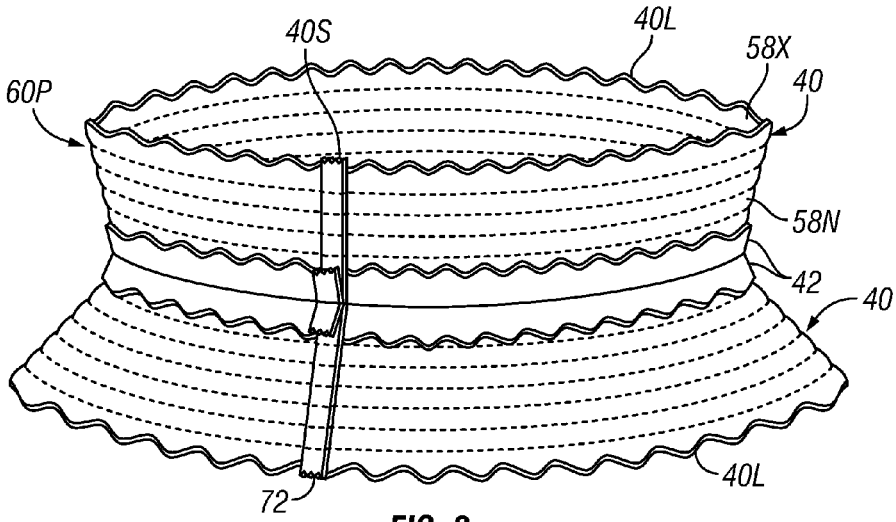
FIG. 2 is a diagrammatic perspective view of a seam joining a pair of bands on an inside of a high fashion hat, showing the stitching pattern producing the crushable, blockable construction.

FIG. 2 shows the inside of two bands 40 to illustrate. The band 40 is made from the lamination 50 of materials and has a pair of long edges 40L and a pair of short edges 40S. The short edges 40S are initially sewn together with the outside fabric layer 58X having a plain seam, the plain seam having a pair of raw edges toward the inside fabric layer 58N. The pair of raw edges are sewn into a flat-felled seam 72 such as a French seam to hide the raw edges with a clean finish and present a flat inside fabric layer. The parallel stitching pattern 60P is sewn onto the band as a topstitch, sewing over the flat-felled seam 72. Each band 40 and brim 20 is prepared with the parallel stitching pattern 60P prior to assembling the finished hat. The long edge 40L of a first band 40 is sewed to the long edge 40L of a second band with a simple seam, having the pair of raw edges 42 on the inside fabric layer 58N. The raw edges are later trimmed and bound by covering with a fabric tape to finish the seam. The long edge 40L of the band 40 near the crown is sewn to the circumferential edge of the crown and the seam is bound. The long edge of the band near the brim is sewn to the long edge of the brim and the seam is bound. The trim element is prepared in a similar manner by sewing the lamination into the desired shape, topstitching in the stitching pattern appropriate to the piece onto the trim element and attaching the trim element to the hat.

Referring to FIG. 3, the illustrated hat 10A has a coil-shaped stitching pattern 60CL on the band 40 and brim 30. The short edges of the band are joined in the finished seam 72 as described hereinabove. Topstitching starts any place on the long edge, but preferably at the finished short edge seam 72. The stitching circumnavigates around the band forming a coil-shaped stitching pattern 60CL of rows. The coil-shaped stitching pattern 60CL is easily executed using a sewing machine because the needle does not require repositioning, but stitches continuously from a first long edge to a second long edge, creating a plurality of rows 62 of topstitches. There is a space 64 between each row 62 that is approximately the same width throughout the coil-shaped stitching pattern, forming the sacs. The concentricity of the coil-shaped topstitching in this embodiment, as well as the parallel stitching pattern described in the embodiment hereinabove, allows the hat to collapse on itself without significant wrinkling of the fabric layers. Additionally, pressure from the foam layer adhered to the fabric layer prevents the significant wrinkling of the fabric layer. If minor wrinkling occurs, the open-cell foam aids in refreshing the fabric by channelling steam through the hat to the fabric layers.

FIG. 3 also shows an optional wire 92 at the long edge 30L of the brim 30. The wire 92 is resilient and supple, returning to its original shape when bent, lending additional support to the brim 30. The wire 92 is stitched to the raw edge before finishing the edge with fabric tape. Optionally, a second wire is stitched inside the hat between the pair of raw edges at the seam of the circumferential edge 20E of the crown 20 and the band 40 before finishing the edge with fabric tape.

Figure 8:
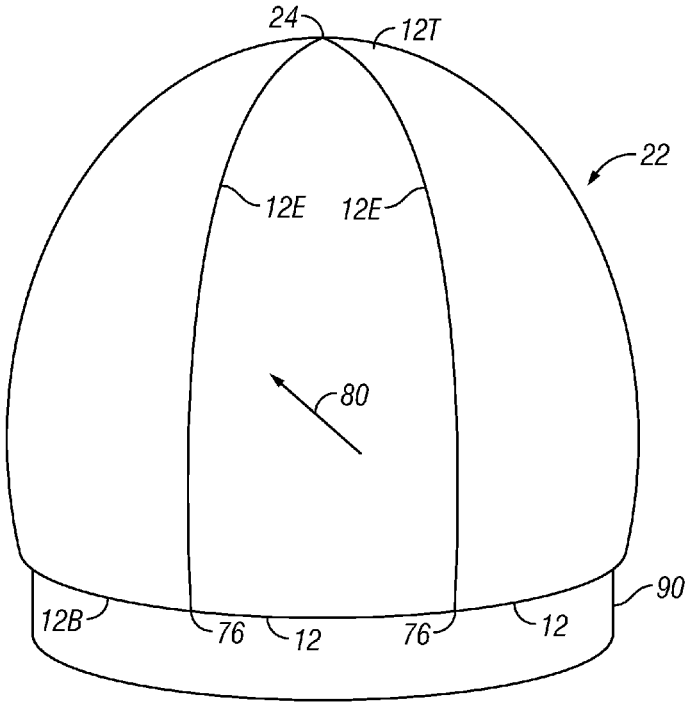
FIG. 8 is a side elevational view of a peaked crown on a block, showing the straight-of-grain line of the fabric.

FIG. 8 shows another embodiment of the invention as illustrated by the high fashion hat that has a peaked crown 22. The peaked crown hat is constructed with the lamination. In the illustration, the peaked crown 22 is on a block 90 used in the blocking process. The peaked crown 22 is formed by a plurality of wedge-shaped panels 12, each panel 12 having a perimeter with a plurality of long edges 12E, a top narrow end 12T and a bottom wide end 12B. Each panel has the lamination, wherein a plurality of straight-of-grain lines of the woven materials are aligned. Woven materials have a grain 80 which is a longitudinal arrangement of fiber in the material. The panel is "cut on the bias," that is, the grain 80 of the material is at a forty-five degree angle to the cut long edges 12E of the panel 12.

Each panel 12 has the long edges 12E and attaches to an adjoining panel 12 by a seam 76 from the top 12T of the long edge to the bottom 12B, with the narrow ends 12T of the panels 12 joining at a peak 24 of the crown.

Figure 9:
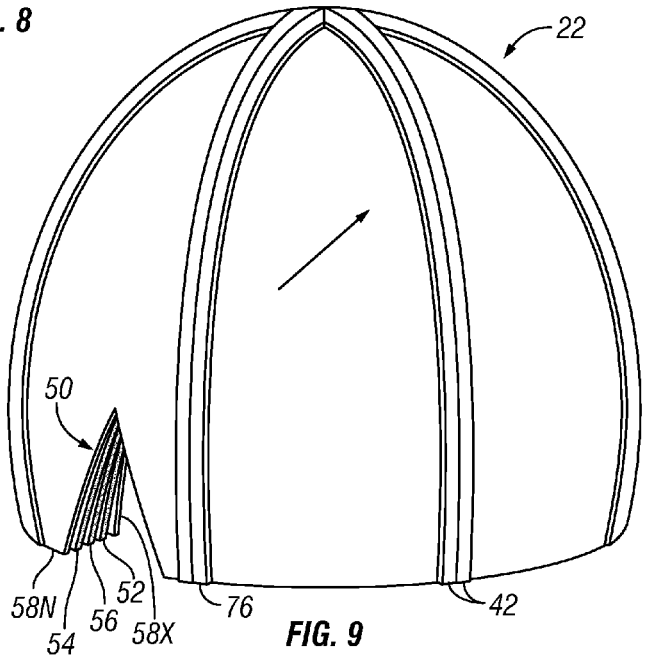
FIG. 9 is a diagrammatic perspective view of a peaked crown, shown turned inside out, showing the stitching, with a cutout to show the lamination producing the crushable, blockable construction.

FIG. 9 shows the inside of the peaked crown 22 showing the seams 76 attaching a first panel 12 to a second panel 12. The seams 76 are simple seams with the raw edges 42 trimmed, pressed open and flat or optionally covered by fabric tape. The cut away section illustrates the layers of the lamination 50, showing the center open-mesh layer 56 sandwiched by the pair of foam layers 52 adhered to the open-mesh layer 56 by a pair of adhesive layers 54, forming a center composite layer, the center composite layer sandwiched between a pair of adhesive layers 54 attaching a pair of fabric surface layers 58N, 58×. The pressure of the foam layer 52 adhered to the fabric layer 58 maintains the shape and prevents significant wrinkling of the fabric layer 58 in this embodiment using the structure of the panels 12 without requiring topstitching.

Referring to FIG. 3, the method of construction of the lightweight, crushable hat 10A with a flat crown 20 starts with aligning all layers of woven materials in the lamination 50, such as the fabric layers 58X, 58N and the optional open-mesh layer 56. The flat crown 20 is cut in a circle or optionally an oval, which is cut on the bias, with straight-of-grain 80 lines of the woven material aligned at an angle with the long axis of the oval. Concentric or spiral stitching patterns 60 are topstitched onto the cut lamination. The band 40 and brim 39 are cut and the short edges are sewn into the flat-felled seam 72. Parallel or coil-shaped stitching patterns 60CL are topstitched onto the closed-circle band 40 or brim 30. As illustrated in FIG. 1, the top edge 40T of the first band 40 is attached to the circumferential edge 20E of the crown 20 by a simple seam. The bottom long edge 40B of the band 40 is sewn by a simple seam to the top edge of the brim 30T or the top edge 40T of the optional second band 40. Additional bands are added in this manner according to the style of the hat. The raw edges of the simple seams and the bottom edge of the brim are bound and finished with fabric tape. An optional wire is added to the edge of the crown or the edge of the brim before binding. The hat is blocked into the desired shape. The optional trim elements constructed from the lamination, topstitched with the stitching pattern, are added after blocking.

Referring to FIG. 8, the method of construction of the lightweight, crushable hat with a peaked crown 22 starts with aligning the straight-of-grain lines 80 of the woven materials in the lamination, such as the fabric layers and the optional open-mesh layer. Cutting the panels 12 into the wedge shape on the bias, sewing the panels 12 together at the long edges 12E with the narrow ends 12T of the panels joining at the peak. The raw edges 42 of the seams 76 are trimmed, opened and pressed flat. The brim formed as described hereinabove is sewn to the bottom 12B of the peaked crown 22 and edge finished with fabric tape. The hat is blocked into the desired shape. Optional trim constructed from the lamination topstitched with the stitching pattern is added after blocking.

In conclusion, herein is presented a a crushable, lightweight high-fashion hat made from a plurality of lightweight, breathable and blockable materials that is constructed by a method of cutting and layering the materials and top stitching the layers in a manner that maintains the shape of the hat and helps restore the shape after crushing. The invention is illustrated by example in the drawing figures, and throughout the written description. It should be understood that numerous variations are possible, while adhering to the inventive concept. Such variations are contemplated as being a part of the present invention.

What is claimed is:

1. A method of constructing a high fashion, crushable, lightweight, collapsible hat, with an initial shape, having a plurality of elements comprising a crown, a brim, and a plurality of bands, each element assembled from a panel cut from a lamination, the lamination having a pair of woven fabric layers, each woven fabric layer having a straight-of-grain line, a plurality of adhesive layers and at least one open-cell foam layer, the open-cell foam layer having a pair of plane surfaces, the open-cell foam layer adhered between the pair of woven fabric layers by the adhesive layers, comprising:

placing the adhesive layers on the plane surfaces of the open-cell foam layer, one on each plane surface;

aligning the straight-of-grain lines of each of the pair of woven fabric layers, the lines directionally aligned with each other;

adhering the woven fabric layers to the adhesive layers on the open-cell foam layer while maintaining the alignment of the straight-of-grain lines of the woven fabric layers such that the straight-of-grain lines of both woven fabric layers are directionally aligned when forming the lamination; and cutting the lamination into the panel; and sewing the panel together to form the element and the elements together to form the hat.

2. The method of constructing the high fashion, crushable, lightweight, collapsible hat as described in claim 1, further comprising the step of stitching a pattern of topstitching on the elements extending through the lamination, forming a plurality of rows, a plurality of spaces between the rows, and a plurality of sacs in the spaces between the rows before sewing the elements together to form the hat.

3. The method of constructing the high fashion, crushable, lightweight, collapsible hat as described in claim 2, further comprising the steps of adhering with an additional adhesive layer an open-mesh layer with a straight-of-grain line and a pair of plane surfaces, a first plane surface and a second plane surface, the first plane of the open-mesh layer adhering to the adhesive layer on the plane surface of the open-cell foam layer, and the second plane surface of the open-mesh layer adhering to the woven fabric layer by the additional adhesive layer before sewing the elements together to form the hat.

4. The method of constructing the high fashion, crushable, lightweight, collapsible hat as described in claim 3, wherein the straight-of-grain line of the open mesh layer is aligned with the aligned straight-of-grain lines of the woven fabric layers.

5. The method of constructing the high fashion, crushable, lightweight, collapsible hat as described in claim 4, further comprising the steps of adhering with an additional adhesive layer an additional open-cell foam layer with a first plane surface and a second plane surface, the first plane surface of the open-cell layer adhering to the second plane surface of the open-mesh layer and the second plane surface of the additional open-cell foam layer adhering to the woven fabric layer by the additional adhesive layer.

6. The method of constructing the high fashion, crushable lightweight, collapsible hat as described in claim 1, further comprising the step of blocking the hat after the elements are sewn together.

* * * * *